US009611622B2

(12) United States Patent
Doherty

(10) Patent No.: US 9,611,622 B2
(45) Date of Patent: Apr. 4, 2017

(54) EXCAVATING ATTACHMENT WITH LATERALLY PIVOTABLE WORKING ARM FOR EXCAVATING BENEATH A BURIED UTILITY

(71) Applicant: Kelvin R. Doherty, Brandon (CA)

(72) Inventor: Kelvin R. Doherty, Brandon (CA)

( * ) Notice: Subject to any disclaimer, the term of this patent is extended or adjusted under 35 U.S.C. 154(b) by 213 days.

(21) Appl. No.: 14/334,982

(22) Filed: Jul. 18, 2014

(65) Prior Publication Data

US 2015/0027007 A1 Jan. 29, 2015

Related U.S. Application Data

(60) Provisional application No. 61/858,302, filed on Jul. 25, 2013.

(51) Int. Cl.

| | |
|---|---|
| ***E02F 5/18*** | (2006.01) |
| ***E02F 5/00*** | (2006.01) |
| ***E02F 3/96*** | (2006.01) |

(52) U.S. Cl.

CPC ..... *E02F 5/18* (2013.01); *E02F 3/963* (2013.01); *E02F 5/003* (2013.01)

(58) Field of Classification Search

CPC ... E02F 3/96; E02F 3/963; E02F 3/815; E02F 3/8152; E02F 3/962; E02F 5/18; E02F 5/00; E02F 5/003; E02F 5/02; E02F 5/022; E02F 5/285

See application file for complete search history.

(56) References Cited

U.S. PATENT DOCUMENTS

| | | | | |
|---|---|---|---|---|
| 1,343,533 | A * | 6/1920 | Ursing | E01B 27/025 37/105 |
| 3,430,706 | A * | 3/1969 | Marron | E02F 3/8152 172/815 |
| 3,651,587 | A * | 3/1972 | Plasser | E01B 27/025 172/735 |
| 3,657,828 | A * | 4/1972 | Anderson | E01H 5/067 172/815 |
| 4,466,491 | A * | 8/1984 | Tower | E02F 5/32 172/136 |
| 5,628,130 | A | 5/1997 | Desrochers | |
| 5,701,693 | A | 12/1997 | Brocious et al. | |
| 5,953,839 | A | 9/1999 | Meeks | |

(Continued)

*Primary Examiner* — Robert Pezzuto
*Assistant Examiner* — Jessica H Lutz
(74) *Attorney, Agent, or Firm* — Kyle R. Satterthwaite; Ryan W. Dupuis; Ade & Company Inc.

(57) ABSTRACT

An attachment is provided for us on an articulated boom of an excavator in order to excavate earth from beneath a buried pipeline or other utility. The attachment features at least one working arm pivotally mounted to a base plate for movement relative to the base plate about an axis passing therethrough. A working end of the arm is thereby movable between a retracted position overlying the base plate and a deployed position reaching laterally outward from an edge of the base plate. With the excavator facing in a longitudinal direction of the utility, and the attachment carried beside the utility at a short depth therebelow by the boom of the excavator, the arm can be deployed and retracted in order to sweep material out from under the pipeline and onto the base plate. The material is then lifted to the surface by raising of the excavator boom.

20 Claims, 3 Drawing Sheets

(56) References Cited

U.S. PATENT DOCUMENTS

| | | | | |
|---|---|---|---|---|
| 6,523,620 | B1 * | 2/2003 | Burson | E01H 5/066 172/815 |
| 7,172,033 | B2 | 2/2007 | Woodcock et al. | |
| 7,963,053 | B1 | 6/2011 | Courville | |
| 8,322,947 | B2 * | 12/2012 | Neumann | E01C 19/15 404/101 |
| 8,631,594 | B1 * | 1/2014 | Moyer | E02F 3/7631 37/361 |
| 2011/0088291 | A1 | 4/2011 | Fluharty et al. | |

* cited by examiner

EXCAVATING ATTACHMENT WITH LATERALLY PIVOTABLE WORKING ARM FOR EXCAVATING BENEATH A BURIED UTILITY

CROSS REFERENCE TO RELATED APPLICATIONS

This application claims benefit under 35 U.S.C. 119(e) of Provisional Application Ser. No. 61/858,302, filed Jul. 25, 2013.

FIELD OF THE INVENTION

The present invention relates generally to excavation machinery, and more particularly to an excavation attachment that features a working arm that can be swung laterally outward from the free end of the articulated boom of an excavator from within an access hole dug beside a buried utility in order to free up and extract earth from beneath the buried utility

BACKGROUND OF THE INVENTION

There are many buried pipelines or utilities in use today. Occasionally it is necessary to repair said utilities without damaging them. To do this you have to excavate the dirt from around the utility. The fastest way do this is using a hydraulically powered machine usually an excavator or backhoe. While this method is safe for digging beside the utility it is not designed to safely dig underneath a utility.

U.S. Pat. No. 5,628,130 teaches an attachment for excavating under buried utilities, but requires operation of the excavating machine in an orientation facing cross-wise to the longitudinal direction in which the utility lies, which in cases where available machine navigation space is limited, may render the attachment unusable or may require excessive clearance of land area adjacent the utility. In addition, between use of the attachment at different locations along the utility, the machine must transition from its laterally-facing orientation suitable for, use of the attachment, to a longitudinally-facing orientation drivable long the utility's path, and then back to the laterally-facing orientation at the new location before once again being able to excavate beneath the utility.

Other known patents relating to excavation or clearing in areas of difficult or limited access are outlined as follows.

U.S. Pat. No. 5,953,839 teaches an attachment for excavating beneath ground-level or slightly elevated pipelines or the like, but again requires a lateral approach of the working machine to the utility.

U.S. Pat. No. 5,701,693 teaches an attachment having a laterally extending dozer blade for clearing road berms of debris beneath roadway guard rails.

U.S. Pat. No. 7,172,033 teaches a culvert opening and cleaning attachment for operation from a roadway surface passing over the culvert to be cleaned.

U.S. Pat. No. 7,963,053 teaches an excavator attachment for cleaning under bridges.

U.S. Pat. No. 7,963,053 teaches an offset shovel assembly for a backhoe excavator for use in otherwise inaccessible locations.

U.S. Patent Application Publication No. 2011/0088291 teaches a dedicated machine for laterally excavating beneath a buried utility, but requires that the machine itself be conveyed down into a dug out area beside the utility in question.

While at least some of the forgoing prior art has applicability in the context of excavating beneath underground utilities, there remains room for improvement or alternate solutions.

Applicant has developed a new excavation attachment and method of use having unique features not heretofore seen that provide useful in the forgoing context of excavating beneath utilities.

SUMMARY OF THE INVENTION

According to one aspect of the invention there is provided an excavating attachment for use on an articulated boom of an excavator to clear earth out from beneath a buried utility, said excavating attachment comprising:

a base;

a coupling unit attached to the base in a position standing upwardly away from a topside of the base and arranged for removable coupling to a free end of the articulated boom of the excavator at a spaced distance above the topside of the base in order to carry the excavating attachment at the free end of the articulated boom;

a working arm situated in a working plane above the topside of the base and pivotally coupled to the base for pivotal motion in the working plane about a pivot axis passing through the base, the working arm having a working end for engaging the earth and a non-working end lying opposite said working end; and an actuator coupled to the working arm and operable to control movement of the working end of the working arm on a respective side of the coupling unit between a deployed position situated laterally outward from the base on the respective side of the coupling unit and a retracted position located nearer to the coupling unit than in the deployed working position.

The deployed position of the working arm reaching laterally outward from the base in the working plane above the topside of the base is operable to reach beneath the buried utility from a dug out hole therebeside, loosen earth beneath the buried utility using the working end of the working arm, and direct the loosened earth onto the topside of the base for lifting of said loosened earth to surface by raising of the articulated boom from the dug out hole. Sweeping of the arm inwardly from said deployed position toward the retracted position in the working plane above the base is also operable to direct earth loosened by the working end of the working arm onto the topside of the base for lifting of said loosened earth to surface by raising of the articulated boom.

Preferably there is provided a second working arm pivotally coupled to the base and pivotal relative thereto about a second axis passing through the base, the second working arm having a second working end that is movable on a second side respective side of the coupling unit between a second deployed position situated laterally outward from the base on the respective side of the coupling unit and a second retracted position located nearer to the coupling unit than in the second deployed working position.

Preferably the actuator is coupled to both working arms.

Preferably there is provided a locking mechanism operable to lock either one of the working arms against movement by the actuator while leaving the other working arm free for movement by the actuator.

Preferably the locking mechanism comprises a removable locking pin selectively engagable with either of the working arms in a manner also engaging the base.

Preferably the actuator is a hydraulic actuator arranged for coupling to hydraulic lines of the working machine for control of the actuator from an operator cabin of the working machine via a hydraulic system of the working machine.

Preferably the base comprises a flat plate.

According to a second aspect of the invention there is provided a method of excavating earth from beneath a buried utility running on a longitudinal axis, the method comprising:

(a) with an excavating attachment carried on the free end of an articulated boom of a working machine that is facing along the longitudinal axis, situating the attachment within an access hole dug out beside the buried utility at a position placing a base and one or more working arms of the excavating attachment at a depth below the utility;

(b) pivoting one of the working arms of the excavating attachment relative to the base from a retracted position of the working arm to a deployed position of the working arm, in which a working end of the working arm reaches laterally outward beyond a respective side of the base to engage the earth beneath the buried utility; and (c) working loose at least some of the earth beneath the utility with the working end of the working arm from step (b).

Preferably step (c) comprises displacing the attachment along the longitudinal axis to scrape away at least some of the earth beneath the utility with the working end of the working arm.

Preferably the method includes step (d) of retracting the working end of the working arm back toward the respective side of the base and using the working arm to sweep loosened earth onto the base during retraction of the working end of the working arm back toward the respective side of the base.

Step (c) may comprise working loose only part of the earth beneath the utility, and further comprising repetition of steps (a) to (c) on a second side of the buried utility via a second access hole dug out on said second side of the utility.

The working machine may face the same direction in the repetition of steps (a) to (c) as in the preceding performance of steps (a) to (c), in which case the working arm used in the repetition of steps (b) and (c) is a second working arm deployed from a second side of the base.

Preferably step (b) and the repetition of step (b) comprise using a same actuator to deploy the two working arms.

Between step (c) and the repetition of step (a), the method preferably includes unlocking the second working worm used in the repetition of steps (b) and (c) and locking the working arm used in steps (b) and (c).

Preferably step (b) comprises using a hydraulic power system of the working machine to pivot the working arm into the working position.

BRIEF DESCRIPTION OF THE DRAWINGS

In the accompanying drawings, which illustrate one or more exemplary embodiments of the present invention.

DETAILED DESCRIPTION

Figure 1:
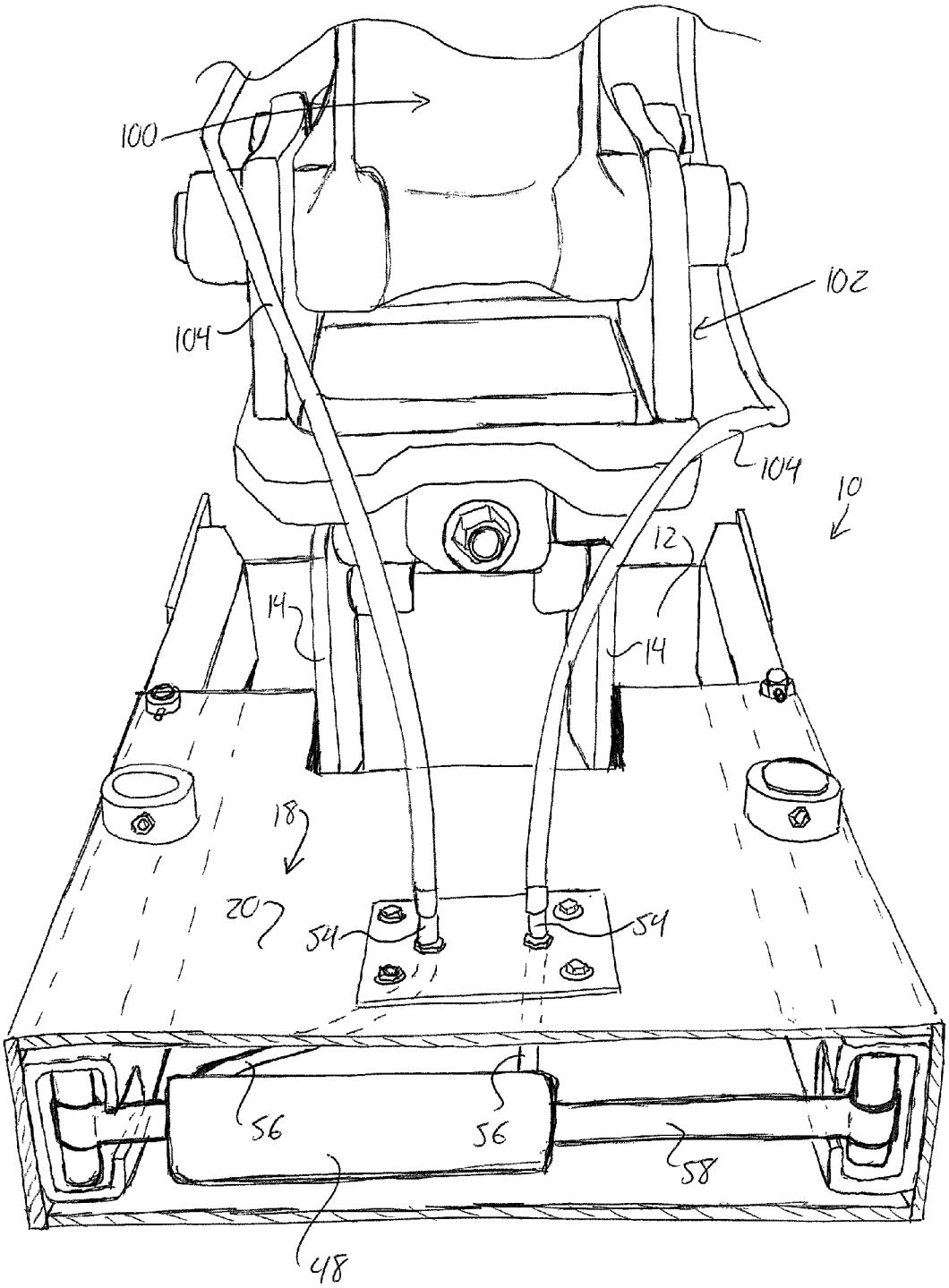
FIG. 1 is a perspective view of a trailing end of an excavator attachment of the present invention carried on the articulated boom of an excavation machine, with working arms of the attachment shown in retracted positions and with a housing end plate cut away to reveal internal components located within a housing of the attachment.
Figure 2:
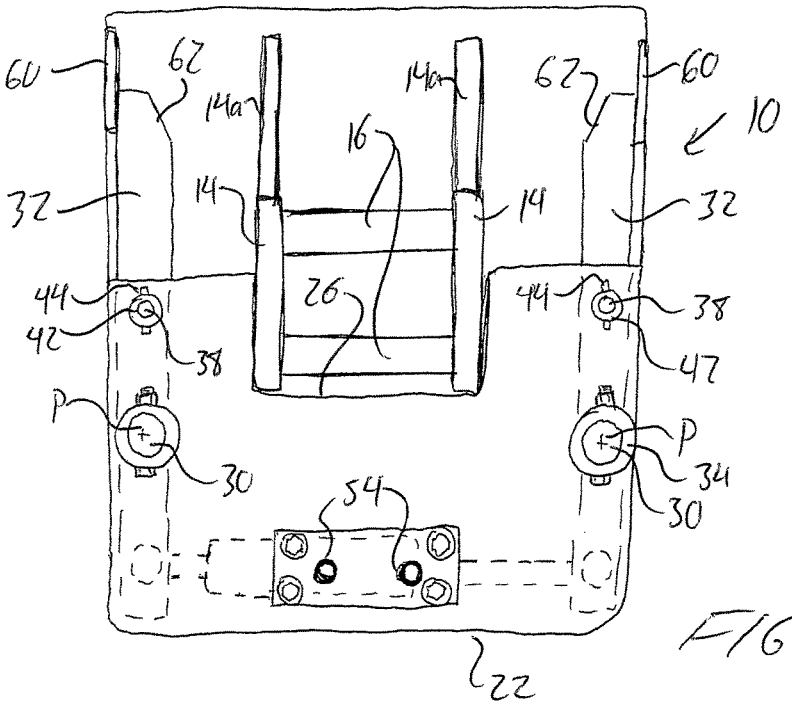
FIG. 2 is an overhead plan view of the attachment of FIG. 1.
Figure 3:
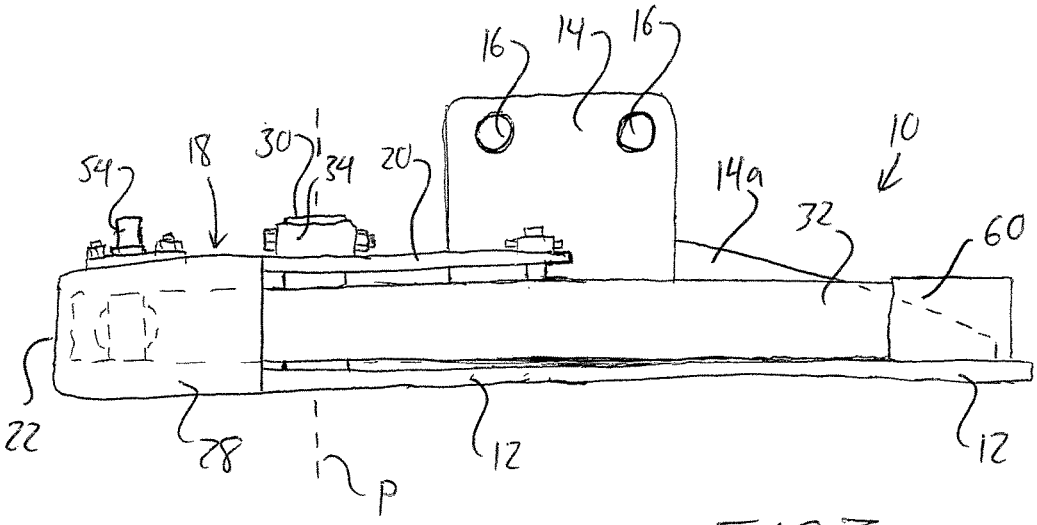
FIG. 3 is a side elevational view of the attachment of FIG. 1.
Figure 4:
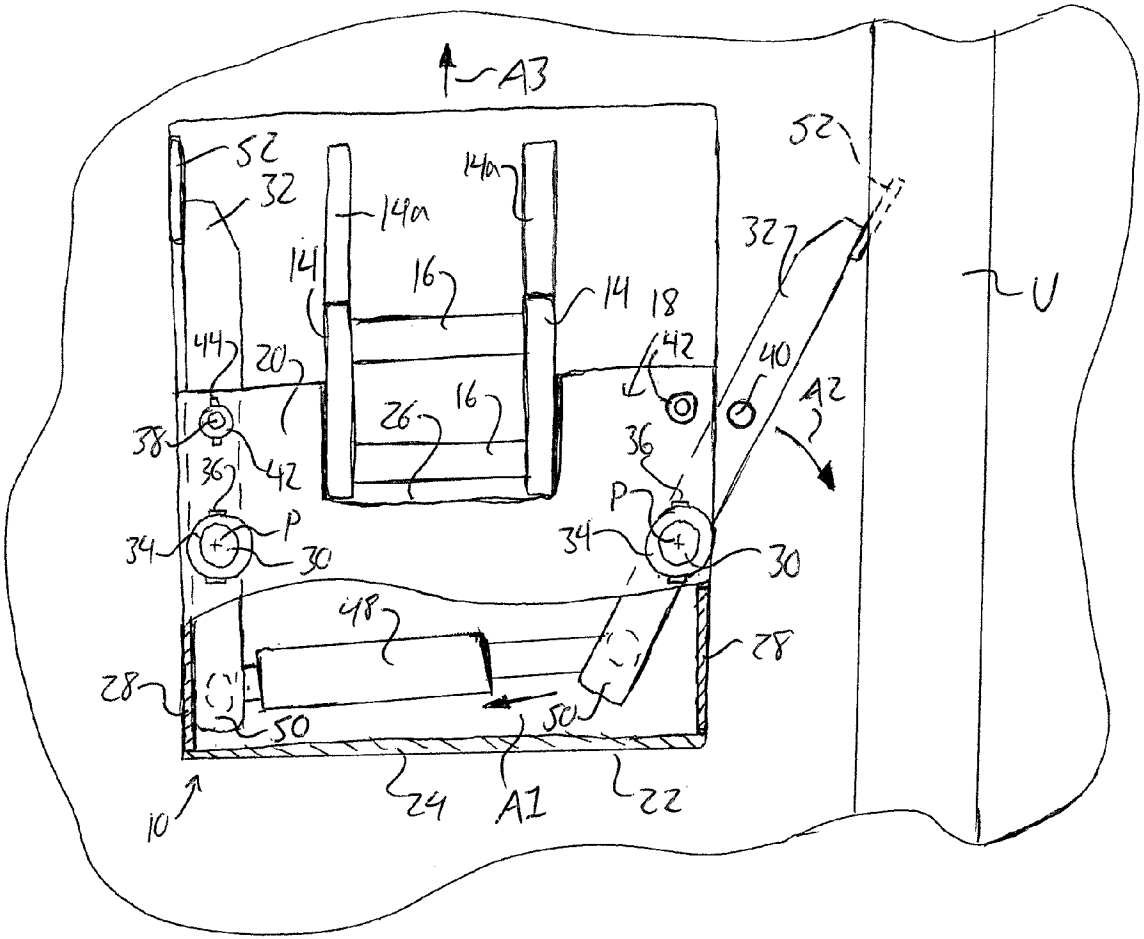
FIG. 4 is an overhead plan view of the attachment of FIG. 1 in a dug out area beside a utility line with one of the working arms in a laterally deployed position angling out from a base plate of the attachment beneath the utility to scrape away earth from therebeneath.

FIG. 1 shows an excavating attachment 10 of the present invention being connected to the free or working end of the articulated boom 100 of an excavating machine. FIGS. 2 through 4 illustrate the excavating attachment in isolation.

The attachment 10 features a flat base plate 12 from which a pair of upright plates or ears 14 project perpendicularly upward from the topside of the baseplate in parallel planes that lie vertically when the base plate is horizontally oriented. The planes of the parallel plates 14 lie in a longitudinal direction that generally matches the longitudinal axis of a pipeline or other utility during excavation of earth from under utility in the manner described herein further below. A pair of transverse pins 16 lie parallel to one another and each span between the two upright plates 14 at a distance above the topside of the base plate 12. The attached uprights 14 and transverse pins 16 are assembled to form a coupling unit that is grippable by a conventional quick-coupler 102 commonly used with excavation machines to grip and release attachments or implements having such a parallel-pin configuration in a quick release manner controllable from the operator cabin of the excavation machine.

As standard well known equipment, further details of the excavation machine and quick release coupler are omitted. It will be appreciated that the attachment of the present invention may be configured with a coupling unit of a type that is instead arranged for coupling directly to the excavator's articulating boom, rather than via a quick release coupler, for example by simply having suitable holes in the upright plates for direct pinning of the attachment to the excavator boom, or may be configured with a coupling unit of a different style arranged for attaching to the excavator boom in another manner.

A housing partially encloses some components of the attachment, and features a top plate 20 lying parallel to the base plate 12 at a distance spaced thereabove, but spans only a partial length of the baseplate's longitudinal dimension from an end thereof that trails the remainder of the attachment during the use of same in the manner described further below with reference to FIG. 4. At this trailing end 22 of the attachment, a trailing end wall 24 of the housing (visible in cross-section in FIG. 4) spans between the top plate 20 and base plate 12 over the full span of their shared common width. In the illustrated embodiment, the top plate 20 is U-shaped in plan, having a shallow central cutaway 26 of rectangular shape in a leading edge thereof, the sides of which are welded or otherwise attached to the upright plates 14 of the coupling unit at the outer faces of these plates. A short side wall 28 parallel to the upright plates 14 spans between the base plate 12 and the top plate 20 at each side of the attachment, but spans only an incomplete portion of the length of the top plate 20 from its connection to the rear wall 24. The rear wall 24 and side walls 28 support the trailing end of the top plate 20, while the leading end of the top plate is supported by its attachment to the upright plates 14, which in turn are fixed to the base plate 12 by welding or other means.

At an intermediate location along each side edge of the top plate 20, a respective pivot pin 30 passes perpendicularly through the top plate 20 and onward through a respective working arm 32 and into, or through, the base plate 12 so as to pivotally support this working arm 32 between these two plates 12, 20 for pivotal movement about a respective pivot axis P perpendicular to these plates in an intermediate plane disposed between and parallel to these plates. Each pivot pin 30 is located slightly ahead of the leading end of the respective side wall 28 of the housing. In the illustrated embodiment, a cylindrical collar 34 fixed atop the top wall 20 surrounds the pivot pin and provides an area for a retaining pin or bolt 36 to pass diametrically through the pin for use in retention of pivot pin to the housing 18.

Braces 14*a* may be attached to the leading edge of the upright plates 14 and the topside of the base plate 12 at the corner defined therebetween and slope downward from the braces toward the leading edge of the base plate to provide stiffness and integrity to the overall structure of the attachment. Although not shown, the top wall of the housing may be doubled up from the rear wall to a location slightly leading the pivot pins in order to provide increases strength at this area of housing through which the pivot pins pass so as to better resist the torque experienced at these pivot pin locations during use of the attachment.

Nearer the leading edge of the top plate 20, at a location adjacent each side of the attachment, a respective locking pin 38 also passes through the top plate 20 on an axis perpendicular thereto, for receipt in a matching hole 40 in the respective working arm 32. A positioning collar 42 and retention pin 44 cooperate to retain the locking pin in place in the same manner those described for the pivot pin, However, the locking pin should be readily removable by a user, and so the retention pin 42 for the lock pin may be a quick release pin 46. When engaged with the respective working arm, the locking pin maintains a stationary position of same. However, when the locking pin is withdrawn from the respective working arm, it frees the working arm for pivotal motion atop the base plate about its respective pivot axis P.

A double acting hydraulic cylinder 48 is coupled between the two working arms 32 inside the housing 18 near the trailing end thereof to provide an actuator for controlling movement of either working arm when not engaged by the respective locking pin. These ends of the working arms 32 coupled together by the cylinder 48 define non-working ends 50 of the arms that remain within the confines of the housing between the opposing top and bottoms plates 12, 20 and the opposing side walls 28, and are not exposed to the earth during use of the attachment, unlike the opposing working ends 52 of the working arms that project outside the housing and work the earth in the manner described further below.

Hydraulic lines 104 from the articulating boom of the excavation machine are connected to hydraulic couplings 54 that are mounted atop the housing near the trailing end of the top wall 20 thereof. Shorter connection lines 56 connect the two hydraulic lines 104 of the machine to the two ports of the double acting cylinder, whereby extension and retracting of the actuator's piston rod 58 can be controlled through the hydraulic system of the excavating machine from the operator cabin of same. FIGS. 1 and 2 show the actuator in a fully extended state positioning the non-working ends 50 of the working arms 32 up against the respective side walls 28 of the housing 18. Retraction of the piston rod 58 further into the cylinder 48, thereby collapsing the actuator, pulls these non-working ends 50 of the working arms 32 toward one another, causing the working ends 52 of the working arms 32 to swing outward from the sides of the base plate 12 about the pivot axes P of the working arms 32.

The fully extended state of the cylinder places the locking pin holes 40 of the working arms in alignment with the holes of the top plate 20 at the locking pin collars 42, whereby the locking pins 38 can be inserted into these aligned holes and secured by their respective retaining pins 44 in order to lock the arms in place. By removing one of the lock pins from such engagement with its respective working arm, but leaving the other locking pin in place, only the unlocked arm will move under operation of the hydraulic actuator. As shown in FIG. 1, each working arm 32 of the illustrated comprises a piece of rectangular tubing with a notch cut into it at the non-working end of the arm at the side of the tubing facing toward the other working arm, whereby a respective end of the actuator reaches into the tubing of the working arm at this notch. Inside the tubing, the eye bracket at the end of the actuator closes around an upright shaft that lies parallel to the pivot shaft of the working arm, thereby forming a pivotal connection between the working arm and the actuator to allow relative pivoting therebetween about an axis parallel to the working arm's pivot axis.

FIGS. 1 to 3 show the apparatus in a non-working state in which the actuator is fully extended and both working arms are in a default retracted position overlying the base plate 12 adjacent the respective side edges thereof, whereby the overall footprint of the attachment equals the area of the base plate 12.

For use of the attachment, first a hole is dug out on one side of the utility that requires excavation of earth from beneath it. The hole is dug to a depth which exceeds that of the underside of the pipe(s) or conduit(s) of the utility. The hole may be dug either by the same excavator on which the attachment is subsequently installed in place of the excavation bucket, or by another machine. The attachment is coupled to the free end of the articulating boom of the excavator in an orientation in which the housing equipped end of the base plate 12 faces away from the operator cabin of the excavation machine. The end of the attachment opposite the housing 18 thus leads the attachment when the articulated boom is swung away from the operator cabin of the excavating machine.

The excavation machine is maneuvered into a position located beside the vertical plane in which the pipeline resides, and at a respective side of the hole from which the machine faces longitudinally along this plane, if not already having been located at such a position for digging out of the aforementioned hole. The locking pin 38 of the working arm 32 closest to the plane of the utility U is disengaged from this arm, thereby freeing the arm for pivotal movement under collapse of the normally extended actuator. From the operator cabin of the excavation machine, which resides at ground level beside the hole, the articulated boom of the working machine is manipulated in a known manner to lower the attachment 10 down into the hole to a depth at which the base plate 12, housing 18 and working arms 32 are situated below the elevation of the underside of the utility.

As shown in FIG. 4, the piston rod 58 of the actuator 48 is retracted using the hydraulic controls of the excavation machine, as shown by arrow A1, thereby causing the working end 52 of the freed working arm to swing outward from the respective side edge of the base plate 12, as shown by arrow A2, thereby engaging the working end 52 of the arm 32 into the earth disposed beneath the utility. The attachment can then be drawn in a longitudinal direction along the utility toward the operating cabin of the excavation machine, as shown by arrow A3, whereby the working end 52 of the working arm that penetrates into the earth beneath the acts to scrape or work the soil and/or other material free from beneath the utility. The acute angle of the working arm 32 relative to the longitudinal direction A3 during this longitudinal movement of the attachment encourages the loosened or freed earth toward and onto the base plate 12. This collection of earth onto the base plate can be further encouraged by extension of the actuator to swing the working end of the working arm back toward the base plate 12, thereby performing a sweeping action drawing the freed earth onto the base plate 12.

Depending on the hardness and packing of the earth beneath the utility, the depth to which the working arm can penetrate the earth when swung out from the base plate may vary, and accordingly multiple longitudinal passes along the pipeline may be required to sufficiently clear out sufficient earth from beneath the pipe at a given elevation of the attachment. The working arm may be extended further out between sequential passes. When a notable accumulation of earth has been collected on the base plate 12, the working arm is retracted by extension of the cylinder, and the articulated boom is used to lift the attachment and the collected earth up to the surface for removal from the hole. In the event of a wide utility featuring a large pipe, or multiple smaller pipes, full cleanout beneath the utility may not be possible from one side of the utility. In this case, another hole is dug out on the other side of the utility, where the attachment can then be used to clear out the remainder of the earth under the utility from the other side thereof. If the excavation machine is used in an orientation facing the same direction along the utility on the second side thereof as on the first side, then the user re-locks the first working arm with its locking pin, and disengages the other locking pin to free up the other working arm, which is now located on the side of the attachment nearest the utility when working from the second side thereof.

As shown, each working arm 32 may feature an excavator tooth, flat plate or other working member 60 of thinner stature than the tubing that forms the bulk of the illustrated arm structure. The working member 60 is attached to an outer side wall of the tubing that faces outwardly away from the base plate 12. The working member 60 extends beyond this end of the tubing to form the working end 52 of the working arm 32. Use of a tooth or other relatively thin member forms more of a cutting, scraping or piercing edge at this distal end of the working arm in order to better penetrate and work free the earth, and the tooth may feature a harder material of greater wear life than the remainder of the attachment. As shown, the tubing may feature a bevel 62 sloping toward the working member 60 from the inner side of the tubing at this end to gradually taper the working arm toward the tip of its working end.

It will be appreciated that many variations to the illustrated embodiment are possible within the scope of the present invention. For example, the shape or structure of the working arms may vary from those described. As an alternative to a two-armed attachment, a less efficient option may be to have only a single working arm, but this may require more complex solutions for providing the ability to cleanout from under the utility on both sides thereof, for example by requiring use of two different attachments depending on which side of the utility is being excavated, or by requiring the user to swap the side of the attachment on which a removable single arm is connected and accommodating connection of the actuator between the arm and a suitable anchoring point on the base in both such possible positions of the removable arm.

Another two-armed embodiment may feature two separate actuators, one for each working arm, instead of a common actuator used for both arms. In such embodiments, the working arms need not necessarily lie and move within a shared common plane, and accordingly the base could be defined by a piece or assembly of different shape that the flat-topped planar base plate of the illustrated embodiment.

As an alternative to the illustrated configuration, another single-actuator embodiment may have the actuator positioned on the side of the pivot pins nearer to the working ends of the arms rather than the non-working ends thereof, in which case extension of the actuator would swing the arm out into the extended working position, and collapse of the actuator would swing the arm inward into the non-working position. Such an embodiment may require relocation of the coupling unit in order to accommodate such placement of the actuator.

Two-armed embodiments may use a locking configuration other than a removable locking pin to secure either or both arms in place. Where a locking pin arrangement is used, one locking pin selectively engagable with either locking arm may be sufficient.

It may also be possible to use an actuator other than a hydraulic cylinder, although one potential advantage of a hydraulically controlled actuator is the ability to use the existing hydraulic system of a conventional excavating machine to control the extension and retraction of the working arms. While the illustrated embodiment is described in the particular context of using an excavator to remove earth from beneath a utility, the attachment may be configured for attachment to other working machines or used for other purposes.

In summary, the illustrated attachment or tool is designed to excavate the dirt from underneath a buried facility. An excavator would dig beside the utility exposing it. Then it would dig approximately two-feet below the utility in both sides of utility. When that depth was reached then the attachment would be fitted on the excavator. Depending on which side of the utility the operator starts on, the operator pins the arm that is furthest from the utility to lock this arm against movement. Lowering the attachment into the fresh dug hole, the operator places the tool on the bottom of the hole. Then by activating the hydraulic ram, the arm that isn't pinned will swing out and engage the soil. While pulling the tool forward, the arm will take dirt safely from underneath the utility. This is repeated until the arm is fully extended then the arm is retracted and pinned then the other side is done in the same manner. Once all the material has been removed the bucket is put back on and the process is repeated until enough of the facility is exposed. This tool keeps the excavator in a parallel line to the utility which is very useful in a situation that has limited room.

The illustrate embodiment provides a simple durable attachment to remove dirt from underneath a utility, and a safe way to remove dirt from under a utility without damaging said utility. Removing dirt from underneath a utility by digging parallel to the utility, one thereby reduces the chance of damaging utility and keeps the movement of the excavator to a minimum. The base plate, top plate, housing walls, working arms and upright plates or ears of the coupling unit are preferably made of steel, but other materials of suitable strength may alternatively be employed.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. An excavating attachment for use on an articulated boom of an excavator to clear earth out from beneath a buried utility, said excavating attachment comprising:

a base;

a coupling unit attached to the base in a position standing upwardly away from a topside of the base and arranged for removable coupling to a free end of the articulated boom of the excavator at a spaced distance above the topside of the base in order to carry the excavating attachment at the free end of the articulated boom;

a working arm situated in a working plane above the topside of the base and pivotally coupled to the base for pivotal motion in the working plane about a pivot axis passing through the base, the working arm having a working end for engaging the earth and a non-working end lying opposite said working end; and an actuator coupled to the working arm and operable to control movement of the working end of the working arm on a respective side of the coupling unit between a deployed position situated laterally outward from the base on the respective side of the coupling unit and a retracted position located nearer to the coupling unit than in the deployed working position;

wherein the deployed position of the working arm reaching laterally outward from the base in the working plane above the topside of the base is operable to reach beneath the buried utility from a dug out hole therebeside, loosen earth beneath the buried utility using the working end of the working arm, and direct the loosened earth onto the topside of the base for lifting of said loosened earth to surface by raising of the articulated boom from the dug out hole.

2. The excavating attachment of claim 1 comprising a second working arm situated above the topside of the base and pivotally coupled to the base for pivotal motion relative thereto about a second axis passing through the base, the second working arm having a second working end that is movable on a second side respective side of the coupling unit between a second deployed position situated laterally outward from the base on the respective side of the coupling unit and a second retracted position located nearer to the coupling unit than in the second deployed working position.

3. The excavating attachment of claim 2 wherein the actuator is coupled to both working arms.

4. The excavating attachment of claim 3 comprising a locking mechanism operable to lock either one of the working arms against movement by the actuator while leaving the other working arm free for movement by the actuator.

5. The excavating attachment of claim 4 wherein the locking mechanism comprises a removable locking pin selectively engagable with either of the working arms in a manner also engaging the base.

6. The excavating attachment of claim 3 wherein the actuator is a hydraulic actuator arranged for coupling to hydraulic lines of the excavator for control of the actuator from an operator cabin of the excavator via a hydraulic system of the excavator.

7. The excavating attachment of claim 1 wherein the base comprises a flat plate lying perpendicular to the pivot axis of the working arm.

8. The excavating attachment of claim 1 wherein sweeping of the arm inwardly from said deployed position toward the retracted position are operable to direct earth loosened by the working end of the working arm onto the base for lifting of said loosened earth to surface by raising of the articulated boom.

9. The excavating attachment of claim 1 in combination with the excavator, wherein the coupling unit is attached to the free end of the articulated boom of the excavator and carries the base beneath said free end of the articulated boom.

10. The excavating attachment of claim 1 wherein the base comprises a flat plate lying perpendicular to the pivot axis of the working arm.

11. A method of excavating earth from beneath a buried utility running on a longitudinal axis, the method comprising:

(a) with the excavating attachment of claim 1 carried on the free end of an articulated boom of an excavator that is facing along the longitudinal axis, situating the attachment within an access hole dug out beside the buried utility at a position placing the base and the working arm of the excavating attachment at a depth below the utility;

(b) pivoting the working arm of the excavating attachment relative to the base to move the working end of the working arm from the retracted position to the deployed position, to engage the earth beneath the buried utility; and (c) working loose at least some of the earth beneath the utility with the working end of the working arm.

12. The method of claim 11 wherein step (c) comprises displacing the attachment along the longitudinal axis to scrape away at least some of the earth beneath the utility with the working end of the working arm.

13. The method of claim 11 further comprising step (d) of retracting the working end of the working arm back toward the respective side of the base and using the working arm to sweep loosened earth onto the base during retraction of the working end of the working arm back toward the respective side of the base.

14. The method of claim 11 wherein step (c) comprises working loose only part of the earth beneath the utility, and further comprising repetition of steps (a) to (c) on a second side of the buried utility via a second access hole dug out on said second side of the utility.

15. The method of claim 14 wherein the excavator faces the same direction in the repetition of steps (a) to (c) as in the preceding performance of steps (a) to (c), and a second working arm deployed from a second side of the base is used in the repetition of steps (b) and (c).

16. The method of claim 15 wherein step (b) and the repetition of step (b) comprise using a same actuator to deploy the two working arms.

17. The method of claim 16 comprising, between step (c) and the repetition of step (a), unlocking the second working worm used in the repetition of steps (b) and (c) and locking the working arm used in steps (b) and (c).

18. The method of claim 11 wherein step (b) comprises using a hydraulic power system of the excavator to pivot the working arm into the working position.

19. An excavating attachment for use on an articulated boom of an excavator to clear earth out from beneath a buried utility, said excavating attachment comprising:

a base;

a coupling unit attached to the base in a position standing upwardly away from a topside of the base and arranged for removable coupling to a free end of the articulated boom of the excavator at a spaced distance above the topside of the base in order to carry the excavating attachment at the free end of the articulated boom;

a working arm situated in a working plane above the topside of the base and pivotally coupled to the base for pivotal motion in the working plane about a pivot axis passing through the base, the working arm having a working end for engaging the earth and a non-working end lying opposite said working end; and an actuator coupled to the working arm and operable to control movement of the working end of the working arm on a respective side of the coupling unit between a deployed position situated laterally outward from the base on the respective side of the coupling unit and a retracted position located nearer to the coupling unit than in the deployed working position;

wherein the deployed position of the working arm reaching laterally outward from the base is operable to reach beneath the buried utility from a dug out hole therebeside and loosen earth beneath the buried utility using the working end of the working arm, and sweeping of the arm inwardly from said deployed position toward the retracted position in the working plane above the base is operable to direct earth loosened by the working end of the working arm onto the topside of the base for lifting of said loosened earth to surface by raising of the articulated boom.

20. The excavating attachment of claim 19 in combination with the excavator, the coupling unit being attached to the free end of the articulated boom of the excavator and carrying the base beneath said free end of the articulated boom.

* * * * *